US006305387B1

(12) United States Patent
Atchison

(10) Patent No.: US 6,305,387 B1
(45) Date of Patent: Oct. 23, 2001

(54) HAIR STYLING TOOL

(76) Inventor: Becky K. Atchison, 907 Woodcrest, Houston, TX (US) 77018

( * ) Notice: Subject to any disclaimer, the term of this patent is extended or adjusted under 35 U.S.C. 154(b) by 0 days.

(21) Appl. No.: 09/524,975

(22) Filed: Mar. 14, 2000

(51) Int. Cl.[7] ..... A45D 8/22; A45D 8/00
(52) U.S. Cl. ..... 132/278; 132/279; 132/276
(58) Field of Search ..... 132/278, 279, 132/280, 281, 282, 283, 284, 273, 275, 255, 256, 257, 258, 276

(56) References Cited

U.S. PATENT DOCUMENTS

| | | | | |
|---|---|---|---|---|
| 1,591,644 | * | 7/1926 | Radcliffe | 132/281 |
| 1,886,887 | * | 11/1932 | Keilhamer | 132/281 |
| 2,795,233 | * | 6/1957 | Zore | 132/281 |
| 3,076,465 | * | 2/1963 | Solomon | 132/278 |
| 3,258,016 | * | 6/1966 | Roepnack | 132/255 |
| 3,837,350 | * | 9/1974 | Terrell et al. | 132/281 |
| 4,056,109 | * | 11/1977 | Takai | 132/255 |
| 4,974,613 | * | 12/1990 | Ho | 132/259 |
| 5,036,870 | * | 8/1991 | Edmark | 132/273 |
| 5,165,429 | * | 11/1992 | Miller | 132/263 |
| 5,201,329 | * | 4/1993 | Quackenbush | 132/248 |
| 5,303,723 | | 4/1994 | Schach | 132/246 |
| 5,494,059 | | 2/1996 | Barrows et al. | 132/273 |
| 5,499,638 | | 3/1996 | Ripley | 132/273 |
| 5,566,690 | | 10/1996 | Shih-Ming | 132/276 |
| 5,597,000 | | 1/1997 | Gerber | 132/279 |
| 5,623,953 | | 4/1997 | McDowell | 132/210 |
| 5,669,398 | | 9/1997 | Dadgostar | 132/210 |
| 5,775,345 | * | 7/1998 | Chou | 123/278 |
| 5,833,335 | | 11/1998 | Voughlohn | 132/273 |
| 5,890,494 | | 4/1999 | Sonstegard | 132/273 |
| 5,979,465 | | 11/1999 | Marrese et al. | 132/248 |

* cited by examiner

*Primary Examiner*—John J. Wilson
*Assistant Examiner*—Robyn Kieu Doan
(74) *Attorney, Agent, or Firm*—Carrie A. Boone; Lundeen & Arismendi, LLP

(57) ABSTRACT

A hair styling tool may secure hair in a variety of styles. The hair styling tool may be constructed from an elastomeric material so that it may be shaped for a variety of hair styles. The hair styling device grips the hair using two clamping surfaces, which may particularly hold fine hair in place. The hair styling tool may be secured using picks. The picks may be adorned with a variety of accessories.

19 Claims, 9 Drawing Sheets

HAIR STYLING TOOL

BACKGROUND

This application relates to hair accessories and, more particularly, to a hair styling tool which holds fine hair.

Human hair comes in a great variety of colors, lengths, and textures. A well-groomed head of hair can make a positive impression on others. Having an attractive hair style may be as important as wearing appropriate attire.

Particularly for women, the use of hair styling tools such as barrettes is well-known. Whether to hold the hair in place or for an ornamental effect, hair barrettes may be used in long and short hair styles. Pins, clips, and scrunchies are also popular hair styling accessories.

For longer hair styles, a French twist is a favorite style. French twists are made by wrapping the hair in a cylindrical fashion. Typically, the hair is wrapped around some styling device, then pinned into place close to the head. For an elegant look, a professional appearance, or simply to get the hair out of the way, the French twist is a versatile choice.

For thin or fine hair, styling the hair may be frustrating. This is because many hair styling implements depend somewhat on the thickness, the texture, and the length of the hair in order to be effective. The ineffectiveness of the hair styling device may be overcome by adding pins, such as bobby pins, or combs, to help hold the hair in place. Such additional effort and hardware may make the style more difficult to achieve, may be cumbersome to adjust during the day, may irritate the head, or may make the style less attractive.

Thus, there is a need for a hair styling device which is easy to use with a variety of hair types and which is effective to hold the hair.

DETAILED DESCRIPTION

In accordance with the many embodiments described below, a hair styling tool may be effective to hold all types of hair. The hair styling tool is designed to grip the hair more successfully than prior art hair styling devices. Thus, the hair styling tool may be particularly beneficial for persons with fine hair. Further, in some embodiments, the hair styling tool is constructed with materials which increase its ability to hold the hair.

Figure 1A:
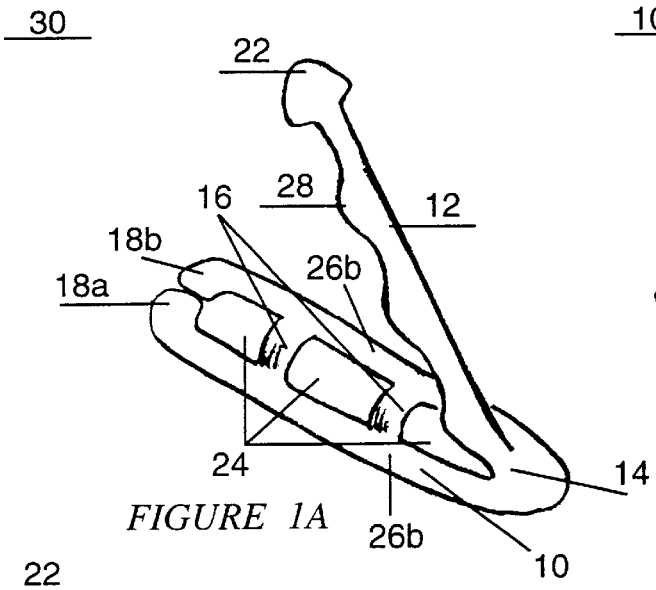
FIGS. 1A and 1B are front and side perspective views of the hair styling tool according to one embodiment.

In FIG. 1A, a hair styling tool 100, according to one embodiment, includes a body member 10 and an arm member 12, connected by a flexible hinge-like coupling 14. The body member 10 comprises a left elongated portion 26*a* and a right elongated portion 26*b*. The left elongated portion 26*a* is substantially parallel to the right elongated portion 26*b*.

In one embodiment, the body member 10 of the hair styling tool 100 is made of a non-slip rubber type or other elastomeric material. Such material helps to keep even thin and fine hair from slipping out of the hair styling tool 100. The body member 10 is elongated such that, when hair is wrapped around the hair styling tool 100, a cylindrical roll may be created, such as in a French twist hair style.

Extending from the left and right elongated portions 26 of the body member 10 are left and right end members 18. The arm member 12 likewise includes a closure member 22. The end members 18 and the closure member 22 form a latch mechanism 30, for engaging the hair styling tool 100 to the hair.

In one embodiment, the latch mechanism 30 is a simple design so that the hair styling tool 100 may be engaged and disengaged from behind a user's head. Once engaged, the hair is held securely while rolling into different styles. The latch mechanism 30 may also be disengaged to release the hair.

Connecting between the left and right elongated portions 26 of the body member 10 are one or more cross-bar members 16. In one embodiment, the cross-bars connect the two elongated portions 26*a* and 26*b* of the body member 10. One or more open spaces 24 may be found between the cross-bar members 16, between the cross-bar member 16 and the end members 18, and between the cross-bar member 16 and the flexible coupling 14. The open spaces 24 provide room for the arm member 12 of the hair styling tool 100 to rest in between the left and right elongated portions 26 of the body member 10.

Figure 1B:
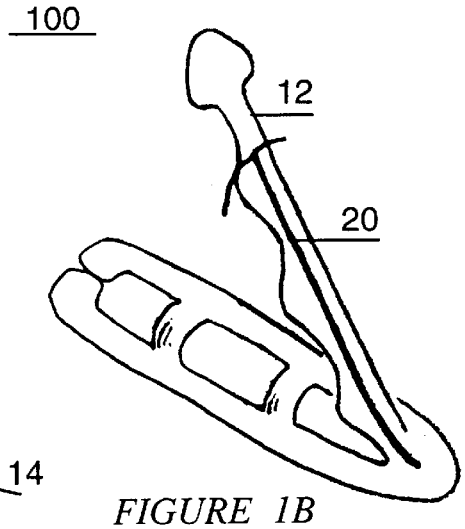

In FIG. 1B, the arm member 12 includes a centrally extending wire 20. In one embodiment, the wire 20 is a metal rod encased inside the arm member 12 of the hair styling tool 100. This allows the hair styling tool 100 to be bent or deformed in a variety of shapes. Further, the hair styling tool 100 may be returned to an elongated position after having been deformed. The wire 20 is completely covered by a strong elastomeric material so as to avoid making contact with the hair or head of the user.

In some embodiments, the arm member 12 may further include a corrugated portion 28. The corrugated portion 28 may fit into the open spaces 24 of the body member 10 when the latch mechanism 30 is in its engaged position. The corrugated portion 28 may particularly help to hold thin hair more securely. The corrugated portion 28 fits more deeply into the body member 10 of the hair styling tool 100 than the rest of the arm member 12 while in the engaged position. This coupling of the arm member 12 with the body member 10 improves the likelihood that the hair will be held in place.

Figure 2:
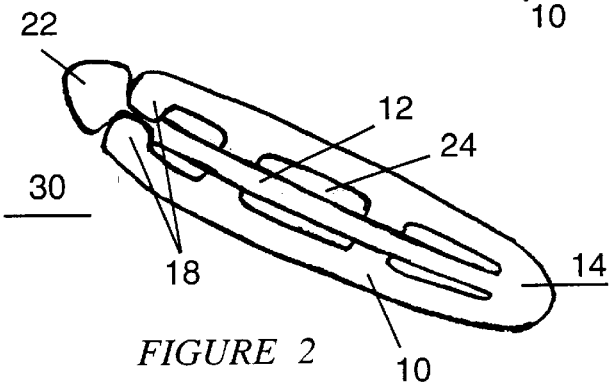
FIG. 2 is a front and side perspective view of the hair styling tool in a closed position according to one embodiment.

In FIG. 2, a top view of the hair styling tool 100, according to one embodiment, shows how the arm member 12 fits between the left and right elongated portions 26 of the body member 10 while in the engaged position. While in use, the open spaces 24 may be filled with hair. Further, the open spaces 24 may be used to add a pick (not shown) through the hair styling tool 100. The picks are described in more detail, below.

Figure 3:
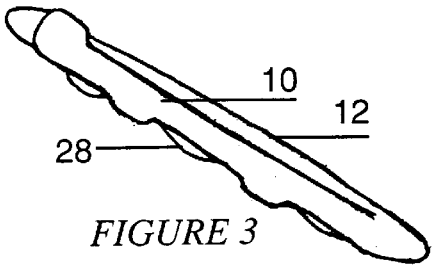
FIG. 3 is a side view of the hair styling tool according to one embodiment.

In FIG. 3, a side view of the hair styling tool 100 shows how the corrugated portion 28 of the arm member 12, available in some embodiments, may extend below the body member 10 while the hair styling tool 100 is engaged. By having these corrugated portions 28 fitting deeply into the body member 10 of the hair styling tool 100, fine or thin hair may be held securely.

Figure 4:
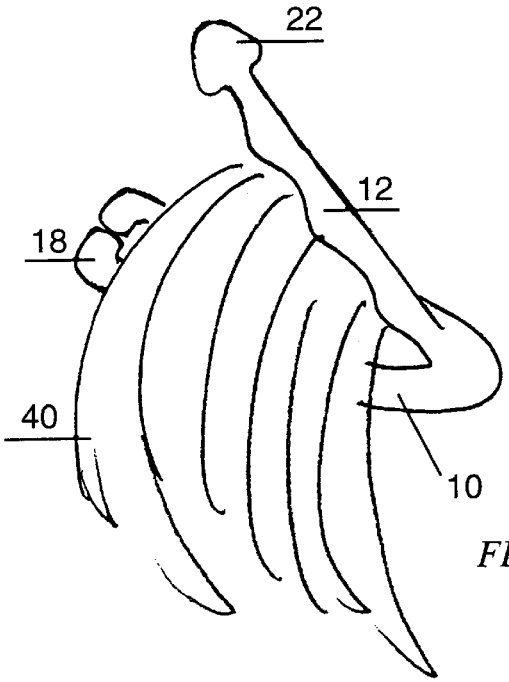
FIG. 4 is a front and side perspective view of the hair styling tool in an opened position according to one embodiment.

In FIG. 4, according to one embodiment, the arm member 12 of the hair styling tool 100 is extended so that hair 40 may be placed on the body member 10. Once the hair 40 is in position, the latch mechanism 30 may be engaged, forming a complete closure around the hair 40. The arm member 12 may be clamped down over the hair such that the closure member 22 is engaged between the end members 18.

In some embodiments, the arm member 12 is made of the same non-slip elastomeric material as the body member 10, for effectively securing the hair 40 in the hair styling tool 100. By fitting between the left and right elongated portions 26 of the body member 10, the arm member 12 deforms the hair somewhat, such that the hair 40 is not planar.

Figure 5:
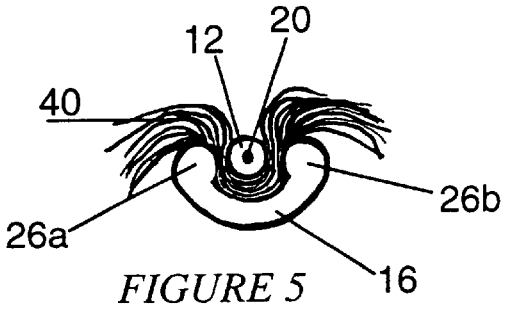
FIG. 5 is a cross-sectional view of the hair styling tool according to one embodiment.

In FIG. 5, a cross-sectional view of the hair styling tool 100 further illustrates the non-planar positioning of the hair 40, according to one embodiment. The left elongated portion 26*a*, the cross-bar member 16 and the right elongated portion 26*b* assume a non-planar, concave shape. By engaging the arm member 12 between the left and right elongated portions 26, the hair 40 also assumes a non-planar shape.

Further, the hair 40 is secured in two places within the hair styling tool 100. In essence, the hair styling tool 100 includes two clamping surfaces for the hair. The left elongated portion 26*a* coupled to the arm member 12 form one clamping surface. Independently, the right elongated portion 26*b* and the arm member 12 form a second clamping surface.

Figure 6:
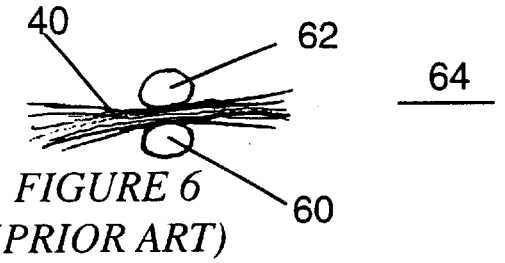
FIGURE 6 (PRIOR ART)
FIG. 6 is a cross-sectional view of a prior art hair styling tool according to one embodiment.

In FIG. 6, a cross-sectional view of a prior art hair styling tool, is distinguishable from the hair styling tool 100 of FIG. 5. Assume that the apparatus of FIG. 6 is a conventional hair styling implement 64, consisting of a body 60 and an arm 62. The arm 62 clamps over the hair and secures onto the body 60 in a conventional manner. The hair 40 is secured between the arm 62 and the body 60 to form a single clamping surface.

Looking back to FIG. 5, the hair being held in a substantially non-planar configuration may create a more secure hold than the flat engagement of the hair 40 in FIG. 6. The hair 40 is curved about the arm member 12 in such a way that the first clamping surface formed by the left elongated portion 26*a* and the arm member 12 hold the hair 40 in a position almost perpendicular to the crossbar member 16. The second clamping surface formed by the right elongated portion 26*b* and the arm member 12 also hold the hair 40 in a position almost perpendicular to the crossbar member 16. By deeply embedding the hair 40 against the concave shape of the body 10 of the hair styling tool 100, the hair 40 may be effectively secured.

In contrast, the implement 64 of FIG. 6 provides a less secure hold. While the hair 40 is held by the arm 62 and the body 60 of the implement 64, the hair 40 of FIG. 6 remains substantially planar, thus increasing the likelihood of slippage.

Figure 7A:
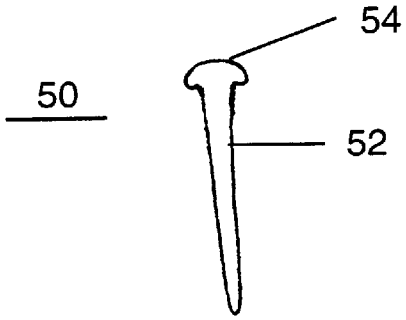
FIGS. 7A–7C are front views of a pick used with the hair styling tool according to one embodiment.
Figure 7B:
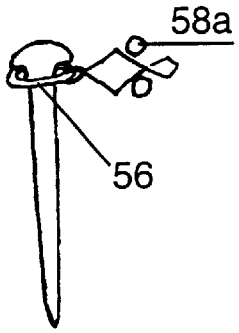
Figure 7C:
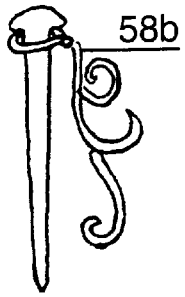

In some embodiments, the hair styling tool 100 may be secured to the head using a pick 50, as shown in FIGS. 7A–7C. The pick 50 may come in a variety of shapes and materials. In one embodiment, the pick is comprised of a stem 52 and a head 54, where the stem 52 is a straight body made of a strong plastic material. From the side view of FIG. 7A, the head 54 and the stem 52 are somewhat "T"-shaped. The stem 52 and the head 54 may be formed together from the same materials. Alternatively, the head 54 may be constructed of a different material, such as an elastomeric material.

The simple shape of the pick 50 allows for a strong leveraged hold when placed through the body member 10 of the hair styling tool 100, as in FIGS. 11A–11D, below. By using a strong plastic material, the pick 50 may not readily be bent out of shape during use. Further, the pick 50 is easy to use. In contrast to such hair fastening devices as bobby pins or combs, the pick 50 may simply be inserted into the hair, such as in the open space 24 of the hair styling tool 100.

The "T"-shaped head 54 of the pick 50 allows the user to push the pick 50 completely into the hair styling tool 100 without the pick 50 accidentally coming out the other side of the tool 100. The simple shape of the pick 50 further allows the pick 50 to be hidden within the hair 40 for an attractive style.

The pick 50 may also be used with one or more accessories 58. In FIGS. 7B and 7C, accessories 58 may be threaded through the stem 52 of the pick 50. In one embodiment, the accessory 58 is coupled to a ring 56, used to thread the accessory 58 through the stem 52. The head 54 of the pick 50 may keep the accessory 58 from slipping off. A variety of accessories 58 including beads, stones, veils, to name a few, may be used with the pick 50 in securing the hair styling tool 100 to the head, as in FIGS. 12A–12H, below.

Figure 8A:
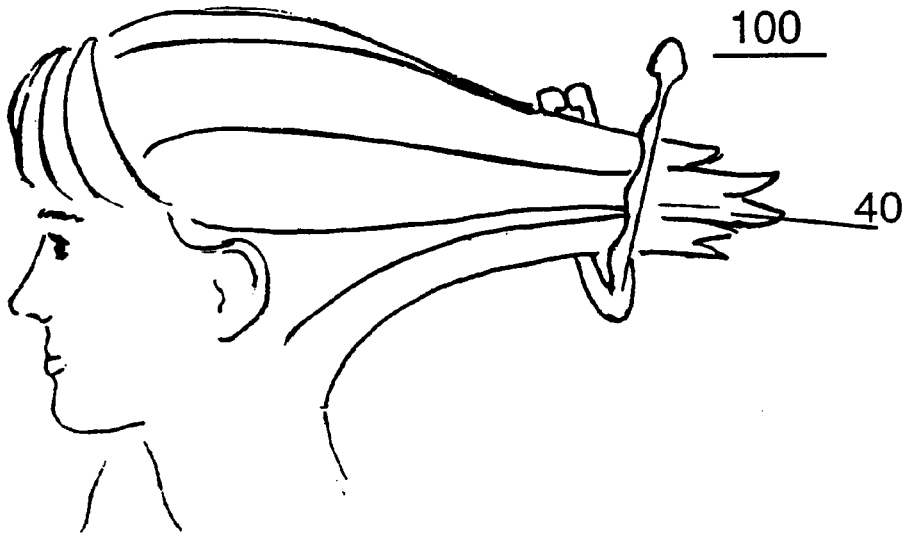
FIGS. 8A–8E are illustrations of one use of the hair styling tool according to one embodiment.

In one embodiment, the hair styling tool 100 may be used to create a French twist hair style, as in FIGS. 8A–8E. In FIG. 8A, the hair 40 is held straight back and the tool 100 is extended around the ends of the hair 40, as described in FIG. 4, above. The position of the hair styling tool 100 along the length of the hair 40 may be varied according to the hair stylist's preference.

In one implementation, the hair styling tool 100 is placed about half way down the length of the hair 40, as in FIG. 8A. The hair is then rolled vertically, as in FIG. 8B. When the rolled hair touches the head, as in FIG. 8C, one or more picks 50 may be inserted to secure the style in place.

Figure 8B:
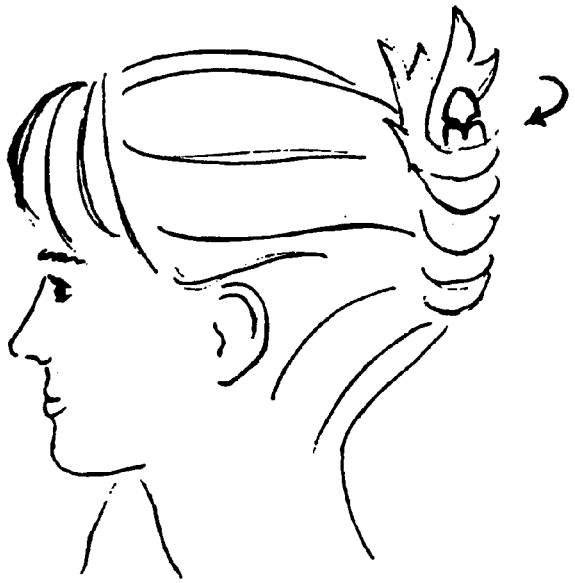
Figure 8C:
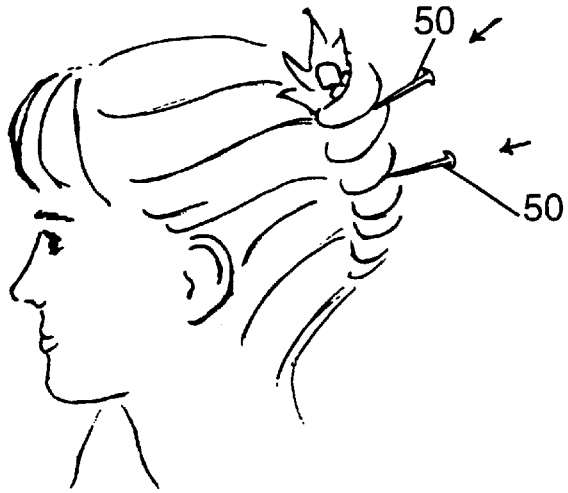
Figure 8D:
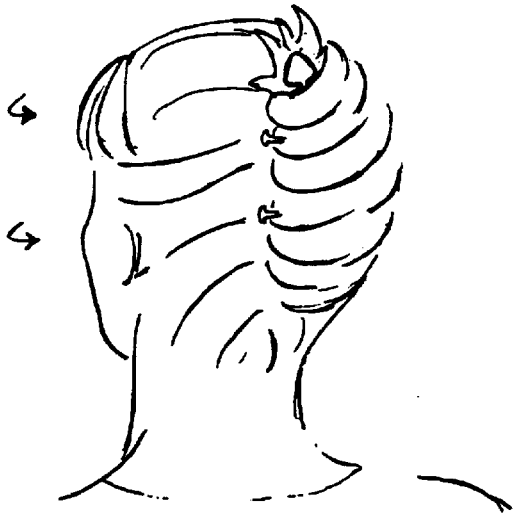
Figure 8E:
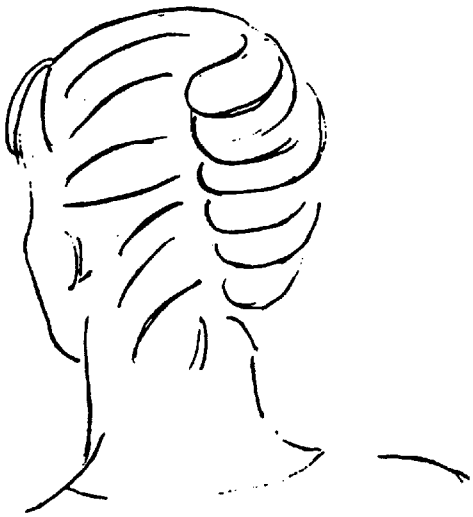

In FIG. 8C, the picks 50 are inserted through the middle of the French roll; in FIG. 8D, the picks 50 are inserted through the side of the French roll. In some embodiments, the picks 50 rest in the open spaces 24 of the hair styling tool 100. The picks 50 may be inserted according to the hair stylist's preference. In FIG. 8E, the closure member 22 is covered by the remaining hair and the picks 50 are inserted such that they are no longer visible.

Figure 9A:
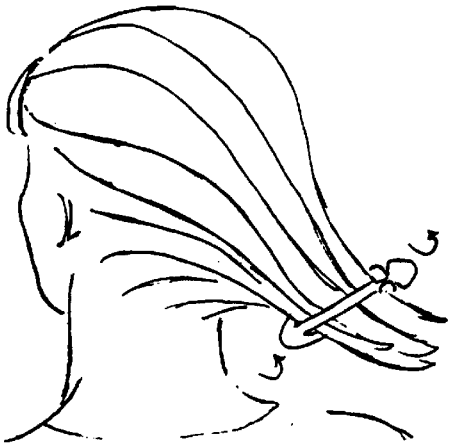
FIGS. 9A–9D are illustrations of a second use of the hair styling tool according to one embodiment.
Figure 9B:
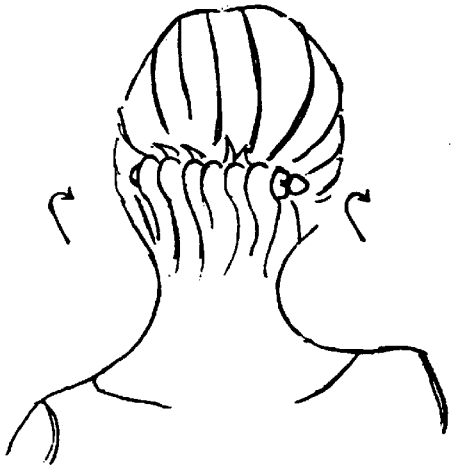
Figure 9C:
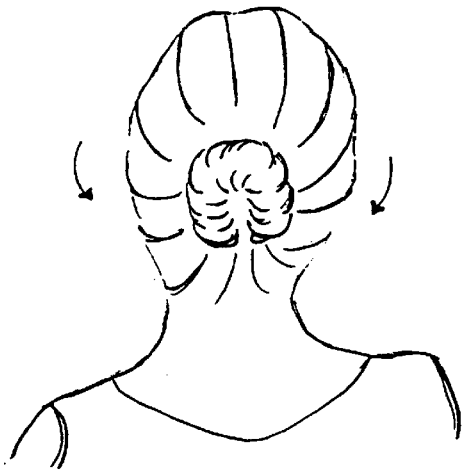

The hair styling tool may also be used to fashion the head in a bun style, as in FIGS. 9A–9D. In FIG. 9A, the hair 40 is held straight back into a loose ponytail. The hair styling tool 100 is then extended around the hair 40 horizontally halfway down its length, and then secured. The hair 40 is then rolled upward toward the head, as in FIG. 9B.

Figure 9D:
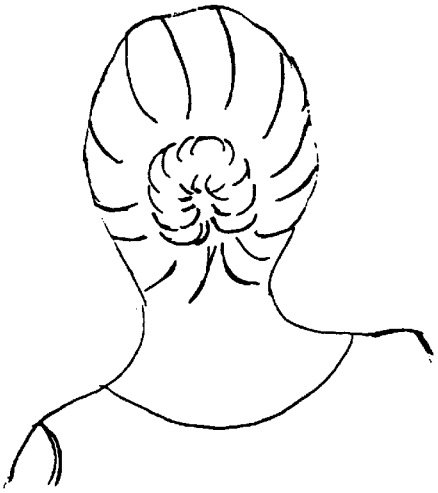

Once the hair is tight against the scalp (FIG. 9C), the ends of the hair styling tool 100 are bent downward to form a circle, as in FIG. 9D. Recall that, in some embodiments, the hair styling tool includes a centrally extending wire 20 inside of the arm member 12 of the tool 100 This wire 20 makes the hair styling tool 100 malleable such that the tool 100 may be bent downward to form the circle, as in FIG. 9D.

Upon removing the hair style, the tool 100 may be returned to an elongated position, such as for use with a French twist style (see FIGS. 8A–8C).

Figure 10A:
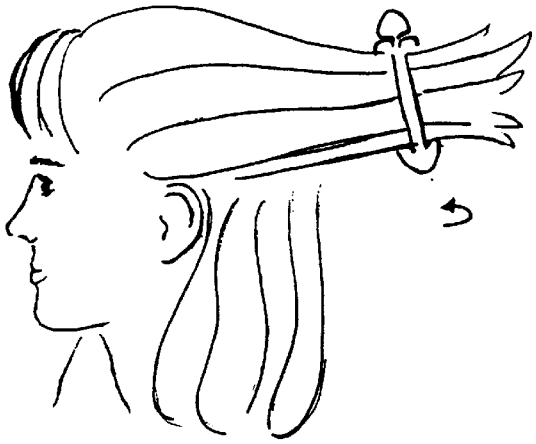
FIGS. 10A–10C are illustrations of a third use of the hair styling tool according to one embodiment.
Figure 10B:
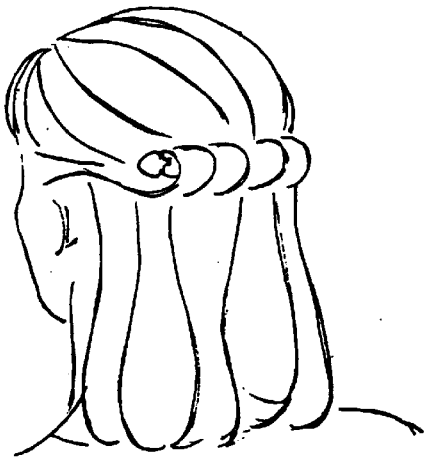
Figure 10C:
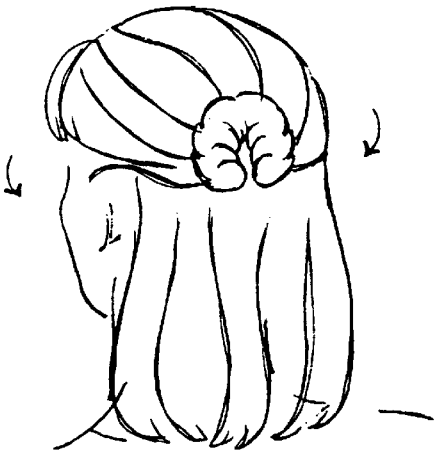

In FIGS. 10A–10D, the hair styling tool 100 may be used to create a partial bun style. First, a top section of the hair 40 is held straight back and the hair styling tool 100 is extended around the hair 40 horizontally (FIG. 10A). The hair 40 is then rolled up toward the head (FIG. 10B) until the tool 100 meets the head (FIG. 10C). The ends of the hair styling tool 100 are bent down to form a circle (FIG. 10D), completing the partial bun style.

Figure 11A:
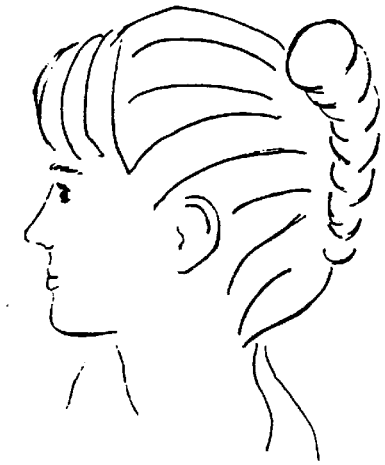
FIGS. 11A–11D are illustrations of the hair styling tool placement on the head, with and without hair, according to one embodiment.
Figure 11B:
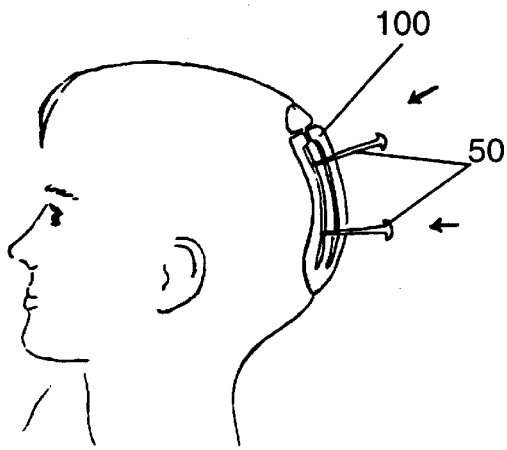
Figure 11C:
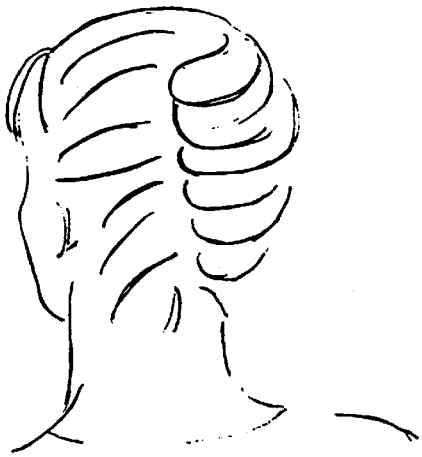
Figure 11D:
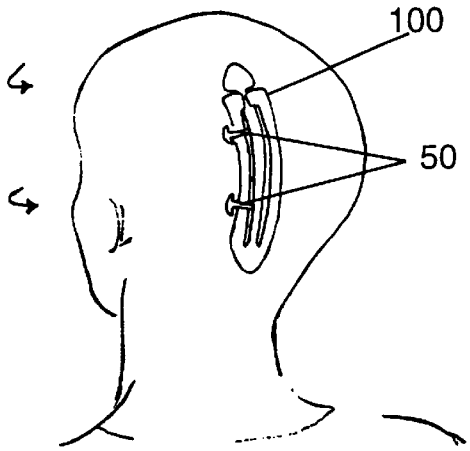

In FIGS. 11A–11D, side and back views of the hair styling tool 100, with and without hair, features the popular French twist style. In the side view of FIG. 11A, a French twist style is created using the hair styling tool 100, yet is completely hidden by the hair 40. In FIG. 11B, the side view without the hair illustrates how the pick 50 may secure the hair styling tool 100 to the head. In FIG. 11C, in a back view of the French twist hair style, the hair styling tool 100 is still hidden by the hair 40. FIG. 11D shows the back view without hair.

As FIGS. 11A–11D illustrate, the picks 50 may be inserted through the hair styling tool 100 perpendicular to the head until each pick 50 touches the scalp. In this embodiment, the picks 50 are tilted against the direction of the roll of the hair style and slid under the hair styling tool 100 for a secure leveraged hold.

Figure 12A:
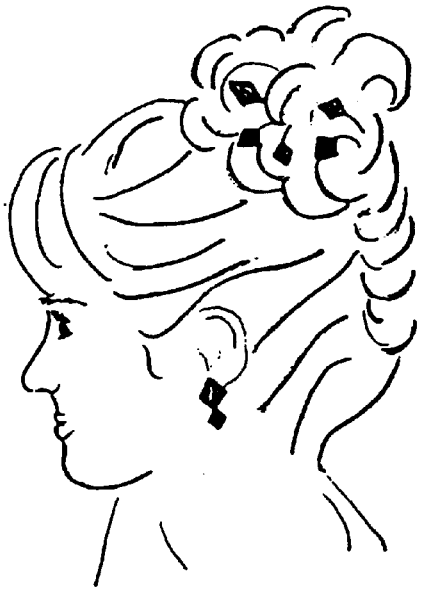
FIGS. 12A–12H are illustrations of the hair styling tool used with accessories according to several embodiments.
Figure 12B:
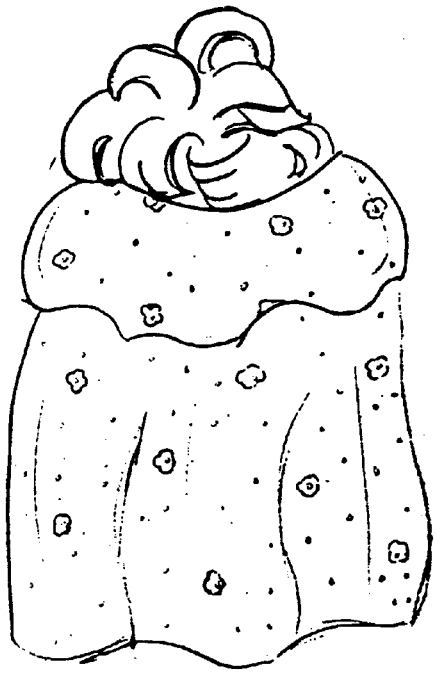

In FIGS. 12A–12H, the hair styling tool 100 may be accessorized in a number of ways. For example, as described in FIGS. 7B–7C, accessories 58 may be added to the pick 50 of the hair styling tool 100. In FIG. 12A, accessories 58 are connected to the picks 50 (not shown) and may be worn with matching earrings. In FIG. 12B, the hair styling tool 100 may be adorned with a veil to complement the hair style.

Figure 12C:
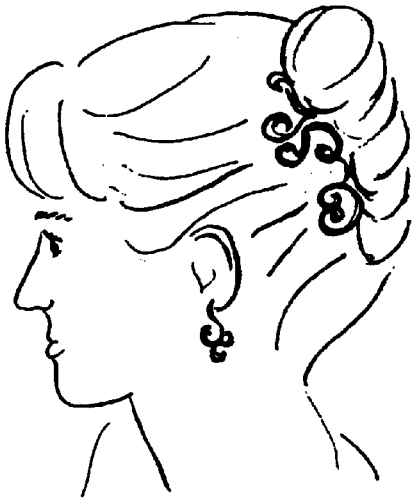
Figure 12D:
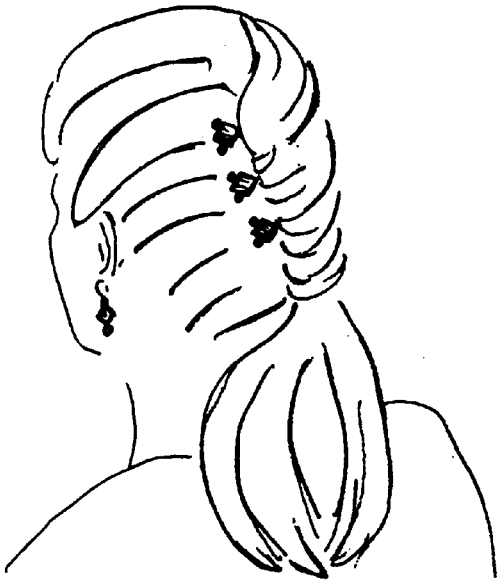
Figure 12E:
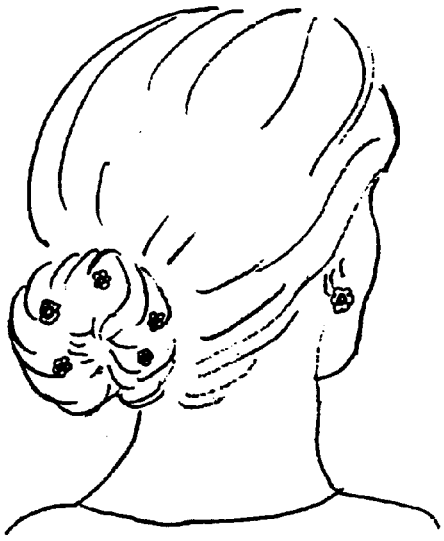
Figure 12F:
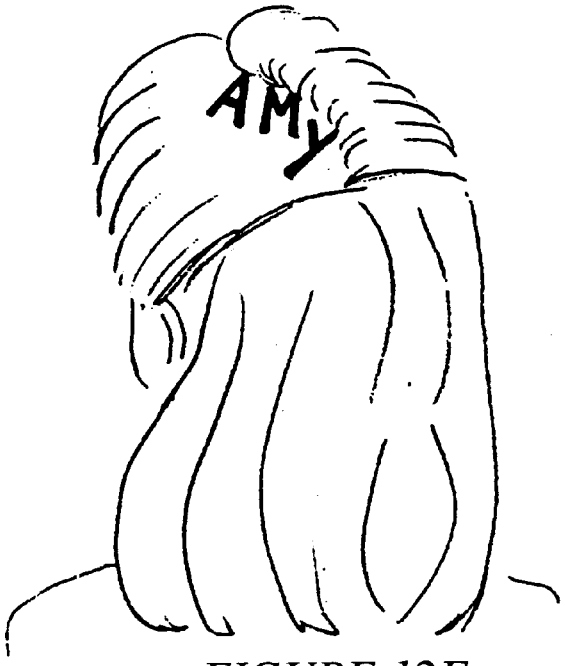
Figure 12G:
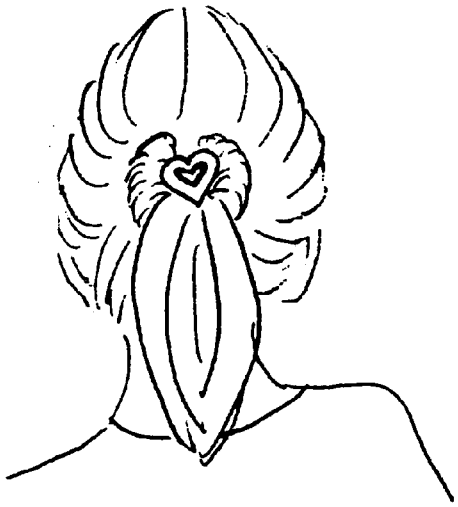
Figure 12H:
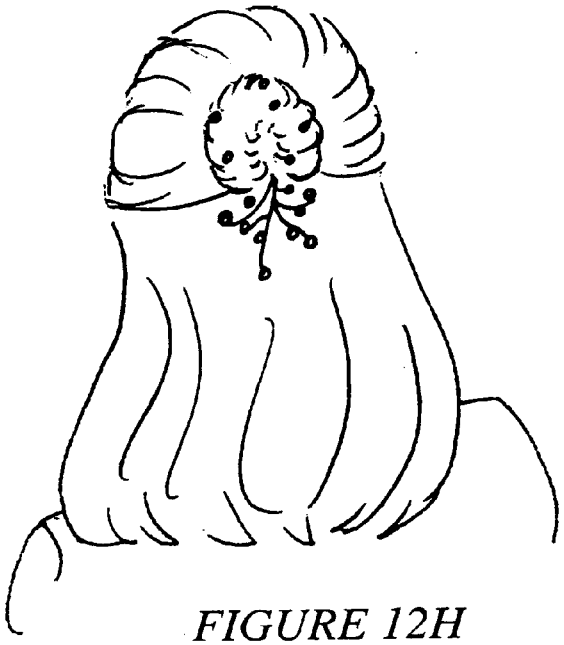

In FIG. 12C, a necklace and earring match the accessory 58 used with the hair styling tool 100. In FIG. 12D, the accessories 58 also include matching earrings. In FIG. 12E, the picks 50 are not used to hold the hair 40 in place, but instead are used to adorn the hair with the accessories 58 only. In FIG. 12F, the accessories 58 comprise alphabet letters, such as may be popular for children's hair. FIG. 12G depicts a heart accessory 58 while FIG. 12H depicts a more elaborate accessory to use with the hair styling tool 100.

Thus, a hair styling tool may hold hair securely in place for a variety of styles. The hair styling tool may be used with a variety of hair types, and may be particularly beneficial for hard-to-hold fine hair. The hair styling tool may be used for the French twist hair style, a bun style, and others.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An apparatus for styling hair, comprising:

a body member comprising:

a left elongated portion;

a right elongated portion; and a plurality of crossbars coupled between the left elongated portion and the right elongated portion;

an arm member comprising a plurality of waves, the arm member coupled to a first end of the body member; and a latch mechanism for coupling a second end of the body member to the arm member, wherein the arm member secures the hair between the left and right elongated portions of the body member such that the hair is not planar and the plurality of waves fit between the plurality of crossbars when the latch mechanism is engaged.

2. The apparatus of claim 1, wherein the arm further encloses a metal rod.

3. The apparatus of claim 2, wherein the arm and the body comprise an elastomeric material.

4. The apparatus of claim 3, wherein the apparatus further:

may be deformed to a plurality of different shapes; and may be restored to a substantially elongated position.

5. The apparatus of claim 1, wherein the plurality of waves substantially fill a plurality of open spaces in the body member when the apparatus is in a closed position.

6. The apparatus of claim 1, wherein the body and the arm are formed from a single molded piece.

7. The apparatus of claim 1, wherein the arm and the body comprise a plastic material.

8. An apparatus for styling hair, comprising:

a body member comprising a plurality of crossbars and an elastomeric material;

an arm member coupled to a first end of the body member, the arm member comprising a plurality of waves and an elastomeric material and enclosing a metal rod; and a latch mechanism for engaging a second end of the body member to the arm member such that the plurality of waves fit between the plurality of crossbars, wherein the apparatus:

assumes an elongated shape when the latch mechanism is engaged; and maintains a non-elongated shape when substantially deformed.

9. The apparatus of claim 8, wherein the apparatus assumes a circular shape.

10. The apparatus of claim 9, wherein the apparatus may be returned to the elongated shape.

11. The apparatus of claim 8, further comprising a plurality of picks wherein the picks hold the apparatus secure to the head.

12. The apparatus of claim 11, wherein the picks support one or more accessories.

13. An apparatus for styling hair, comprising:

an arm member comprising a plurality of waves and a material enclosing a metal wire;

a body member comprising a plurality of crossbars, the body member coupled to the arm member at a first end; and a latch mechanism to engage a second end of the body member to the arm member for securing the hair such that the plurality of waves fit between the plurality of crossbars, wherein the apparatus may style the hair in a French twist.

14. The apparatus of claim 13, wherein the apparatus comprises an elastomeric material.

15. The apparatus of claim 13, further comprising a plurality of picks.

16. The apparatus of claim 13, further comprising an accessory coupled to the apparatus using one of the plurality of picks.

17. The apparatus of claim 13, wherein the arm member comprises a plurality of waves.

18. The apparatus of claim 17, wherein the body member comprises a plurality of open spaces and the plurality of waves of the arm member fit in the plurality of open spaces of the body member when the latch mechanism is engaged.

19. The apparatus of claim 13, wherein the body member is coupled to the arm member using a hinge.

* * * * *